United States Patent [19]

Travaglio et al.

[11] 4,008,873

[45] Feb. 22, 1977

[54] ANGULARLY ADJUSTABLE SHELF BRACKET

[75] Inventors: Vincent M. Travaglio, Rolling Meadows; Michael L. Magnifico, Chicago, both of Ill.

[73] Assignee: Emhart Industries, Inc., Farmington, Conn.

[22] Filed: Jan. 29, 1976

[21] Appl. No.: 653,292

[52] U.S. Cl. ..... 248/242; 108/108; 211/186

[51] Int. Cl.² ..... A47G 29/02; A47F 3/06

[58] Field of Search ..... 248/242, 223; 211/148; 108/108

[56] References Cited

UNITED STATES PATENTS

| | | | |
|---|---|---|---|
| 3,089,675 | 5/1963 | Lozier | 248/242 |
| 3,199,821 | 8/1965 | Story | 248/242 |
| 3,538,860 | 11/1970 | Fisher | 248/242 X |
| 3,602,472 | 8/1971 | Tyrrell | 248/242 |
| 3,729,161 | 4/1973 | Christensen | 248/242 |

FOREIGN PATENTS OR APPLICATIONS

| | | | |
|---|---|---|---|
| 1,044,843 | 10/1966 | United Kingdom | 248/242 |

*Primary Examiner*—J. Franklin Foss
*Attorney, Agent, or Firm*—Hill, Gross, Simpson, Van Santen, Steadman, Chiara & Simpson

[57] ABSTRACT

An angularly adjustable shelf supporting bracket of the type provided with a plurality of vertically spaced retaining fingers on the butt end of a shelf-carrying arm has shoulders on the upper edges of the fingers shoulders facing toward the butt end for angular position determining engagement with bars across the tops of openings in a upright supporting structure, and shoulders on the lower edges of the fingers facing toward the butt end and engageable with the bars along the lower sides of the openings for interim holding of the bracket against dropping away from the supporting structure when adjusting from one angular position to another.

9 Claims, 7 Drawing Figures

ANGULARLY ADJUSTABLE SHELF BRACKET

This invention relates to the art of adjustable shelving especially of the merchandise display type, and is more particularly concerned with new and improved angularly adjustable shelf supporting bracket structures.

Retail stores of the self-service type such as grocery stores have merchandise display racks for customer convenience. For maximum utility the shelves must be not only vertically adjustable, but also angularly adjustable into various angular relationships to the horizontal. Numerous and varied means have been heretofore suggested for attaining angular shelf adjustments, some of which have been unduly complex and others quite simple in respect to the mechanism for retaining the shelves in selected angularly adjusted positions. However, in respect to the simpler forms a very annoying and sometimes dangerous problem exists in the liability of the shelf dropping away from the vertical supporting structure while shifting from one angular position to another. These shelves are generally of considerable length and especially in the wider shelves of considerable weight and unless expertly and carefully handled with particular attention to avoiding dropping may fall with damaging effect and possible injury to the person attempting to manipulate the shelf from one angular position to another.

By way of example, U.S. Pat. No. 3,089,675 is referred to, disclosing shelf bracket structures adjustable to and between at least three different angular positions. The brackets of that patent have adequate means for retaining the brackets in the various adjusted positions, but when making angular adjustments from one position to another entire reliance is placed upon the manipulator to prevent the bracket retaining fingers from leaving the supporting structure. In other words, it requires a deliberate and considerable effort to prevent the shelves equipped with the brackets of the identified patent from dropping away. It is to the eleviation of this problem that the present invention is primarily directed.

An important object of the present invention is to provide new and improved angularly adjustable shelf supporting bracket structures which will overcome the disadvantages, deficiencies, inefficiencies, shortcomings, and problems in prior structures of this type.

Another object of the invention is to provide new and improved angularly adjustable shelf supporting bracket structure which will permit simple and easy adjustment from one angular position to another with assurance that the bracket structure will not permit the associated shelf to drop away from upright supporting structure.

A further object of the invention is to provide new and improved retaining fingers means for angularly adjustable shelf-supporting brackets especially equipped to avoid shelf drop-away while adjusting for one angular position to another angular position.

According to features of the invention, an angularly adjustable shelf-supporting bracket comprises an elongated arm having a butt end from which extends a plurality of vertically spaced retaining fingers for supporting engagement with horizontal bars which separate vertically spaced openings in an upright supporting structure into which the fingers extend and with respect to which the bracket is adjustable to and between a plurality of different angular positions, the uppermost of the fingers having on its upper edge spaced shoulders facing toward the butt end and engageable with a hole-separating bar to retain the bracket in a plurality of selective different angular positions relative to the supporting structure, a lower finger having on its upper edge a shoulder facing toward the butt end and engageable with a hole-separating bar to retain the bracket in a further angular position relative to the supporting structure, and the fingers having on their lower edges safety catch means, such as shoulders facing toward the butt end and engageable with the hole-separating bars for interim arresting of the bracket against dropping away from the supporting structure when effecting adjustment from one angular position to another.

Other objects, features and advantages of the invention will be readily apparent from the following description of certain representative embodiments thereof, taken in conjunction with the accompanying drawings although variations and modifications may be effected without deparating from the spirit and scope of the novel concepts embodied in the disclosure, and in which.

Figure 1:
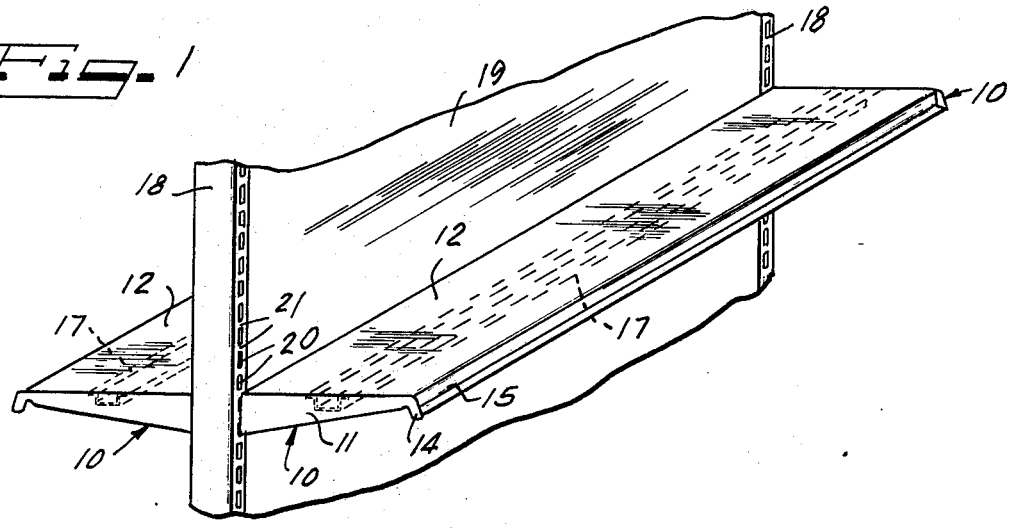
FIG. 1 is a fragmentary isometric view of display shelving embodying features of the invention.

A shelf adjusting bracket 10 embodying the present invention (FIGS. 1–4) comprising an elongated arm 11 for supporting a shelf body 12 of any preferred length and width, there being one of the brackets 10 at each end of the shelf secured to the body 12 in any preferred manner such as by welding, the bracket bodies 11 having their major transverse dimension vertical for stability and desirably of greatest vertical dimension or width at a rear supporting butt end 13 from the which the body 11 extends to a narrower vertical dimension width cantilever fashion to a depending front end terminal portion 14 adapted to accommodate the adjacent end of a tag holding strip 15. For rigidity, one or more reinforcing bars 17 are desirably secured to and between the brackets and at the opposite ends of the shelf and to the bottom of the shelf body 12.

For supporting a shelf as thus described at a suitable height upright supporting structure comprises respective posts 18 mounted on any preferred base and desirably having a backing panel 19 there-between. In a preferred construction the posts 18 are equipped to support shelves at both sides of the upright supporting structure assembly, substantially as indicated in FIG. 1. Although for illustrative purposes only two shelves are shown, it will be understood that a plurality of shelves can be accomodated by the post 18. For coupling of the shelves to the posts 18 through the brackets 10, the posts have uniformly vertically spaced openings 20 separated by horizontal bars 21. Each bracket 10 has extending from its butt end 13 a plurality of vertically spaced retaining fingers comprising at least an upper finger 22 and a lower finger 23 extending into respective ones of the openings 20.

Means are provided on the fingers 22 and 23 for cooperation with the butt end 13 to engage retainingly with the hole-separating bars 21 along the openings 20 through which the fingers extend. To this end, the uppermost finger 22 has on its upper edge spaced shoulders 24 and 25 facing toward the butt end 13 and engageable the adjacent bar 21 to retain the bracket 10 in a plurality of selective different angular positions relative to the supporting posts 18, by way of example, the substantially horizontal but desirably about 1° uptilted position in FIG. 2 and the downwardly and forwardly tilted position in FIG. 3 at about 14°. On the lower finger 23 an upper edge shoulder 27 facing toward the butt end 13 is engageable with the hole separating bar 21 along the upper side of the hole 20 through which this finger projects for retaining the bracket 10 in a further selective angular position relative to the supporting post 18 as shown in FIG. 4 and which may be on the order of 24° downward and forward slope.

Figure 2:
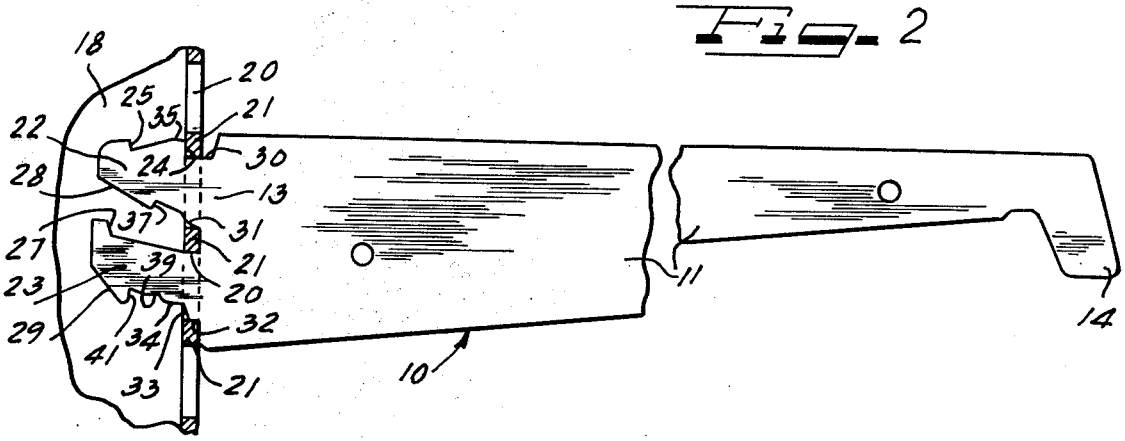
FIG. 2 is a fragmental sectional elevational view of a shelf-supporting bracket showing it in one selected angular adjusted position.

Because it is the most used position, the substantially horizontal position in FIG. 2 has been illustrated first in sequence. In this position and in each of the subsequent positions to be described, the description will center on just one of the brackets 10, but it will be understood that both of the brackets 10 on each shelf will be identical and therefore the description relating to the one bracket will apply to the other and to manipulation of the shelf to which the brackets are attached.

Referring now to FIG. 2, when the bracket 10 is initially assembled with the supporting post 18, the fingers 22 and 23 are introduced into the respective holes 20 at whatever elevation is chosen along the supporting posts 18, such introduction being facilitated by an oblique lower edge lead-in cam surface 28 on the upper finger 22 and a complementary lead-in oblique cam surface 29 on the lower edge of the lower finger 23. After the fingers 22 and 23 have been pushed all the way through the holes 20, the bar 21 along the top of the hole 20 through which the upper finger 22 extends is received in a clearance notch 30 separating the shoulder 24 from the the butt end 13 and the shoulder 24 is engaged against such bar 21. At the same time the bar 21 received between the fingers 22 and 23 is freely engaged by and between the proximal ends of the fingers 22 and 23 with a preferably arcuate movement facilitating shoulder 31 on the proximal end of the lower edge of the upper finger 22 engaging supportingly upon the underlying bar 21 and a shoulder 32 on the lower edge of the proximal end of the lower finger 23 resting on the bar 21 underlying it. At the same time the butt end 13 between the fingers 22 and 23 and below the finger 23 engages in stabilizing relation against both of the bars 21 which are in underlying engagement with the fingers 22 and 23. If it is desired to remove the bracket 10 from the supporting post 18, a reverse maneuver from that which effected the initial coupling will withdraw the fingers 22 and 23 from the associated holes 20.

Figure 3:
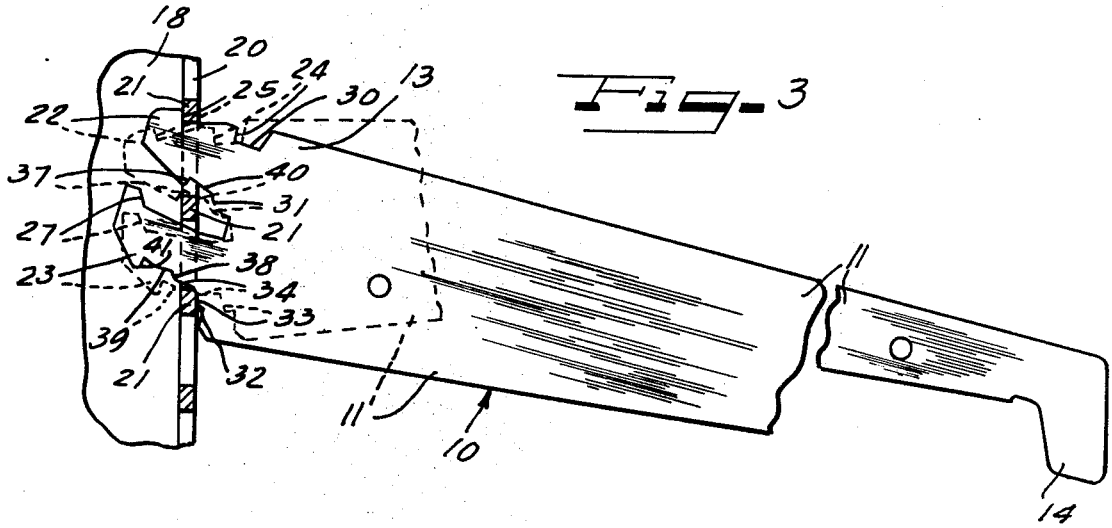
FIG. 3 is a similar view showing the bracket in a second selected adjusted position.
Figure 4:
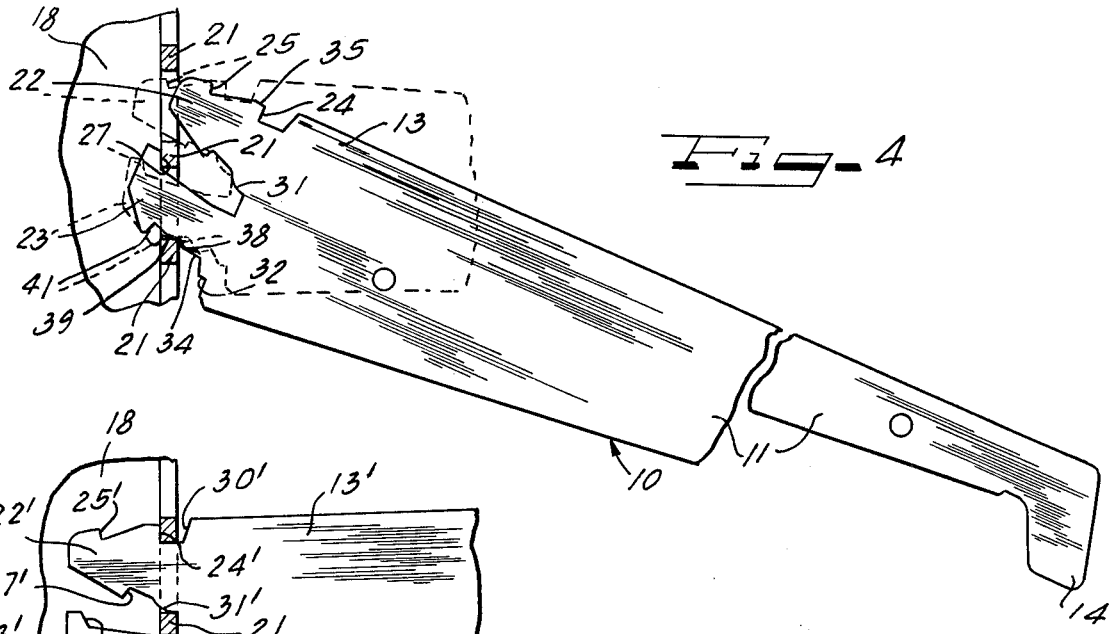
FIG. 4 is a similar view showing the bracket in a third selected adjusted position.

When it is desired to shift the bracket 10 from the substantially horizontally angular position to a second angular position as shown in FIG. 3 and which may be about 14° slope downwardly and forwardly, a simple upward rocking movement while the fingers 22 and 23 remain in projected relation through the respective holes 20 in the support member 18, as exemplified in dash outline in FIG. 3, will cause dropping of the shoulders 31 and 32 from the supporting bars 21. To faciliate this, the shoulders 31 and 32 are slightly narrower than the thickness of the bars 21 so that in the rocking movement these shoulders will escape forwardly from the bars, accompanied by a downward riding, along the forward edges of the underlying bars 21, of the accurate rear cam portion of the shoulder 31 and an oblique cam shoulder 33 leading from the shoulder 32. This causes the butt end 13 to drop slightly till a downwardly facing intermediate shoulder 34 spaced from the shoulder 32 engages the adjacent bar 21. However at this point, the distance between the shoulder 34 and an upwardly facing interference shoulder 35 on the upper edge of the finger 22 immediately rearwardly adjacent the upper end of the shoulder 24 will restrain downward rocking of the bracket 10 to engage the shoulder 25 with the adjacent bar 21, thereby momentarily precluding dropping of the bracket away from the supporting post 18.

Positive retention of the bracket 10 against dropping away from the supporting post 18 when effecting the selected angular adjustment from the substantially horizontal to the first downwardly tilted position shown in FIG. 3 comprises new and improved safety catch means on the lower edge of the upper finger 22 and conveniently and desirably in the form of a shoulder 37 which faces generally toward the butt end 13 in spaced relation to the shoulder 31 in such orientation to the shoulder 34 and the temporary restraining shoulder 35 that when the shoulder 34 clears the adjacent bar 21 to permit further slight dropping of the butt end 13, the shoulder 37 will engage the bar 21 adjacent thereto as shown in dash outline in FIG. 3 and positively arrest the bracket against dropping away from the post 18. Such arresting action is readily sensed by the person manipulating the shelf with which the bracket is associated and will then know that by merely permitting the shelf to swing downwardly under its own weight, the 14° angular position will be maintained by engagement of the shoulder 25 against the adjacent bar 21. To facilitate escape of the shoulder 34 from the adjacent bar 21 during the angle shifting maneuver, the inwardly directed end of the shoulder 34 terminates in an accurate cam lead surface 38 which drops off to a clearance notch surface 39 which is complementary to a clearance notch surface 40 between the shoulder 31 and the shoulder 37. Upon sensing that the safety catch shoulder 37 has caught onto the adjacent bar 21, the person manipulating the assembly swings it downwardly from the dash line position to the full line position of FIG. 3, accommpanied by a rearward push which releases the safety catch shoulder 37 and cams the cam surface 38 past the adjacent bar 21 to reengage the shoulder 34 on such bar, whereupon the butt end 13 is slightly lifted and the shoulder 25 swings into engagement with the associated bar 21 and the surface 33 engages the contiguous bar 21 to cooperate with the shoulder 25 to retain the bracket 10 in the 14° angular tilted position.

When it is desired to shift the bracket 10 from or beyond the 14° position of FIG. 3 to the 24° angular tilted position of FIG. 4 the associated shelf and thereby the bracket 10 is swung upwardly about a fulcrum provided by the shoulder 25. This will cause the weight-supporting shoulder 34 to slide from the adjacent bar 21 and effect camming of the cam surface 38 past the supporting bar, then sliding of the clearance notch surface 39 along and past the bar until safety catch means in the form of a shoulder 41 spaced from the surface 38 and facing generally toward the butt end 13, but spaced farther from the butt end than the shoulder 37, catches on the contiguous bar 21 and arrests the bracket 10 against dropping from the supporting post 18. Such arrest in movement of the bracket is sensed by the person manipulating the shelf with which the bracket is associated and who then merely permits the shelf and the bracket 10 to swing down, which automatically causes the retaining shoulder 27 to engage the adjacent bar 21, and the surface 38 together with the surface 39 engages with the contiguous bar 21 to support the bracket 10 in cooperation with the shoulder 27.

To return the bracket 10 to either of the other selective angular position from either of the 14° to 24° positions of FIGS. 3 and 4, respectively, simple upward swinging of the bracket 10 and slight rearward thrusting which is normal to upward canting by force applied adjacent the forward end of the bracket will cause the appropriate retaining shoulders to be engaged with the associated bars 21. Should at anytime accidental upward force be applied to the shelf with which the bracket 10 is assembled, operation of the safety catch shoulders 37 or 41, as the case may be, will prevent dropping away of the bracket 10 from the post 19. On the other hand, deliberate shifting of the bracket 10 and the associated shelf can be easily, simply and safely effected even by relatively inexperienced persons.

Figure 5:
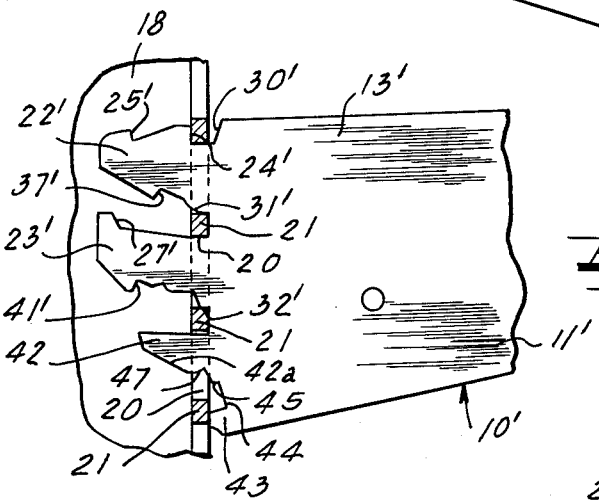
FIGS. 5, 6 and 7 show a modified form of the bracket in three different selected positions of angular adjustment.
Figure 6:
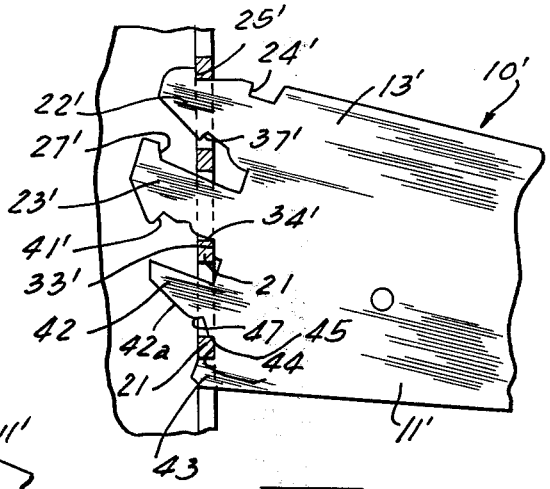
Figure 7:
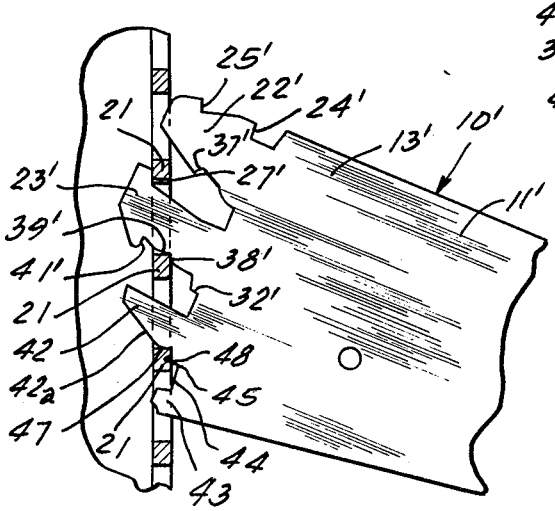

The bracket 10 provided with two retaining fingers is found in a practical sense satisfactory for shelves within a substantial range of depths such as from about 8 inches to about 22 inches in depth. For larger shelf sizes, that is shelves of greater depth such as up to 30 inches as well as for shelves required to support unusual loads, additional load sustaining means are desirably provided for the shelf brackets in relation to the supporting post means. To this end, the bracket 10′ may be equipped as shown in FIGS. 5–7 with an additional finger 42 which has a lower edge lead-in surface 42*a*, which is located adjacently below the lower finger 23′ and projects rearwardly from the butt end 13′ of the bracket body 11′ which for this purpose is substantially wider than the bracket 10. Each of the retaining fingers 22′ and 23′ is substantially identical with the retaining fingers 22 and 23 of the bracket 10 already described and will function in same manner as already described and therefore the description for the construction and functioning of the fingers 22 and 23 is incorporated here by reference.

In the generally horizontal position of the bracket 10′ relative to the supporting post 18, the finger 42 extends freely through the hole 20 subjacent the hole 20 through which the finger 23′ extends, and suitable spaced below the finger 42 a shoulder projection 43 from the butt end 13′ engages against the adjacent bar 21 as shown in FIG. 15, thereby supplementing load bearing thrust of the portions, of the butt end 13′ against the bars 21 which are subjacent the fingers 22′ and 23′, respectively.

In the second angular position (FIG. 6) which may be 14° slope downwardly and forwardly, the shoulder projection 43 underlies the contiguous bar 21 and such bar is engaged by a rearwardly facing thrust surface 44 of the butt end 13′ immediately above the shoulder 43 and offset forwardly from the terminal end of the projection. Thereby the surface 44 shares in cantilever thrust load bearing relation with the thrust shoulder 33′. In addition, a downwardly facing shoulder 45 at the upper end of the thrust surface 44 engages in dead load relation upon the contiguous bar 21 cooperatively with dead load support provided by the shoulder 34′ in this angular position of the bracket 10′.

In a third downwardly and forwardly tilted angular position as shown in FIG. 7, corresponding to the same position in FIG. 4, a generally downwardly facing shoulder 47 on the finger 42 engages in dead load downward supporting relation on the contiguous bar 21, cooperative with the shoulder 39′ of the finger 23′. Rearward thrust is shared with the thrust shoulder surface 38′ by a generally rearwardly facing thrust shoulder surface 48 adjacently below the shoulder 47 and suitably offset rearwardly from the thrust surface 44 to engage the contiguous bar 21 when the retaining shoulder 27′ is in engagement with the contiguous bar 21.

It will be understood that variations and modifications may be effected without departing from the spirit and scope of the novel concepts of this invention.

We claim as our invention:

1. In a shelf supporting bracket comprising an elongated arm having a butt end from which extend a plurality of vertically spaced retaining fingers for supporting engagement with horizontal bars which separate vertically spaced openings in an upright supporting structure through which the fingers extend and with respect to which the bracket is adjustable to and between a plurality of different angular positions:

the uppermost of said fingers having on its upper edge spaced shoulders facing toward said butt end and engageable with a hole-separating bar to retain the bracket in a plurality of selective different angular positions relative to the supporting structure;

a lower finger having on its upper edge a shoulder facing toward said butt end and engageable with a bar to retain the bracket in another selective angular position relative to the supporting structure;

and said fingers having safety catch means on their lower edges comprising shoulders facing toward said butt end and engageable with the hole-separating bars for interim arresting of the bracket against dropping away from the supporting structure when effecting adjustment from one angular position to another;

the lower of said fingers having a safety catch shoulder which is spaced farther from the butt end than a safety catch shoulder on the upper of said fingers.

2. A bracket according to claim 1, having in addition to said safety catch shoulder means, surface structures on the lower edge of the lower of the fingers and on the upper edge of the upper of the fingers cooperative to prevent dropping of the bracket away from the supporting structure at a point in shifting of the bracket between respective angular positions and before said safety catch shoulder means becomes operative.

3. A bracket according to claim 1, including a cam surface on the lower edge of the upper of said fingers for easy shifting movement from one angular position to another angular position.

4. A bracket according to claim 1, wherein the lower edge of the lower finger has stepped surfaces in addition to safety catch shoulder means to facilitate shifting of the bracket from one angular position to another angular position.

5. A bracket according to claim 1, wherein the upper and lower fingers have on their lower edges stepped surfaces to facilitate shifting of the bracket between selected angular positions.

6. A bracket according to claim 1, wherein said lower edges have adjacent to said butt end respective downwardly facing shoulders for supporting the bracket on said bars.

7. A bracket according to claim 1, including three rearwardly facing and rearwardly spaced shoulders along the lower edge of said lower finger providing cantilever support in cooperation with said upper edge shoulders in retaining the bracket in the selective plurality of different angular positions relative to the supporting structure.

8. A bracket according to claim 1, including a third finger below said uppermost and lower finger and providing dead load support in one of the selective angular adjusted positions.

9. A bracket according to claim 8, including three rearwardly facing shoulders below said third finger for thrusting engagement with a bar in three selected angular adjusted positions of the bracket.

* * * * *